US005795443A

United States Patent [19]

Greve

[11] Patent Number: 5,795,443

[45] Date of Patent: Aug. 18, 1998

[54] APPARATUS FOR CONTROLLING FIBER DEPOSITIONS IN SLURRY PREFORMS

[75] Inventor: Bruce Norman Greve, Clarkston, Mich.

[73] Assignee: The Budd Company, Troy, Mich.

[21] Appl. No.: 816,698

[22] Filed: Mar. 13, 1997

[51] Int. Cl.[6] ..... D21J 7/00

[52] U.S. Cl. ..... 162/388; 162/396; 162/416; 162/382

[58] Field of Search ..... 162/388, 396, 162/226, 416, 227, 411, 382, 218, 219, 383; 264/122, 86, 87; 425/85, 86

[56] References Cited

U.S. PATENT DOCUMENTS

| | | | |
|---|---|---|---|
| 1,549,903 | 8/1925 | Buel . | |
| 2,471,932 | 5/1949 | Chaplin . | |
| 2,780,147 | 2/1957 | Richter et al. . | |
| 2,962,762 | 12/1960 | Hartmann et al. . | |
| 3,014,835 | 12/1961 | Feigley, Jr. et al. . | |
| 3,261,740 | 7/1966 | Wells . | |
| 3,284,284 | 11/1966 | Wells | 162/219 |
| 3,325,349 | 6/1967 | Reifers . | |
| 3,449,207 | 6/1969 | Modersohn . | |
| 3,687,587 | 8/1972 | Wiltshire | 425/80 |
| 4,162,935 | 7/1979 | Kollmann et al. . | |
| 4,204,907 | 5/1980 | Korklan et al. . | |
| 4,647,415 | 3/1987 | Schafft . | |
| 4,740,346 | 4/1988 | Freeman . | |
| 4,775,705 | 10/1988 | Parker et al. . | |
| 4,812,283 | 3/1989 | Farley et al. . | |
| 4,818,448 | 4/1989 | Wrenn, Jr. et al. . | |
| 4,849,147 | 7/1989 | Freeman . | |
| 4,863,771 | 9/1989 | Freeman . | |
| 4,882,114 | 11/1989 | Radvan et al. . | |
| 5,039,465 | 8/1991 | Freeman et al. . | |
| 5,286,326 | 2/1994 | Greve . | |
| 5,407,631 | 4/1995 | Salisbury | 264/517 |

FOREIGN PATENT DOCUMENTS

| | | |
|---|---|---|
| 587989 | 12/1959 | Canada . |
| 47-7726 | of 1972 | Japan . |
| 197805 | 5/1978 | United Kingdom . |

OTHER PUBLICATIONS

"Wet Slurry Process brings Precision to Reinforced Plastics", Keown, J.A., Curtis, R.W., Cimastra Division, The Cincinnati Milling Machine Co., pp. 18–22.

*Primary Examiner*—Stanley S. Silverman
*Assistant Examiner*—Jose A. Fortuna
*Attorney, Agent, or Firm*—Harness, Dickey & Pierce, P.L.C.

[57] ABSTRACT

An apparatus for making fiber reinforced preforms using a wet slurry process wherein the flow of liquid through portions of a screen having a predetermined configuration is selectively controlled. The selective control of the flow of liquid through the portions of the screens regulating the quantity of fibers deposited on the selected portions of the screen thereby controlling the thickness of the fiber preform at the selected portions of the screen.

20 Claims, 3 Drawing Sheets

APPARATUS FOR CONTROLLING FIBER DEPOSITIONS IN SLURRY PREFORMS

BACKGROUND OF THE INVENTION

1. Technical Field

The present invention relates generally to forming fiber reinforced plastic structures and, more particularly, to a method and apparatus for controlling the fiber deposition of a fiber preform used in making a fiber reinforced plastic structure.

2. Discussion

Fiber reinforced plastic (FRP) parts are presently being used in a wide variety of applications and are finding increased popularity. A FRP part generally consists of a plastic shape in which reinforcing fibers have been dispersed in order to provide additional strength. One method of making FRP parts is known as resin transfer molding (RTM). In RTM, fibrous material is placed in a mold and is injected with resin which cures to form the part. Examples of these techniques are disclosed in commonly assigned U.S. Pat. Nos. 4,740,346; 4,849,147; 4,863,771; and 5,286,326 which are hereby incorporated by reference. In RTM, fibrous material is often formed into a preliminary shape before being placed into the mold. The shaped sections generally conform to the shape of adjacent mold die surfaces and are known as preforms. Preforms have been made in several different manners. One approach is to direct chopped fibers onto a screen along with a binder. One problem with this technique is that it is difficult to obtain the desired fiber orientation. Another method is to make the preforms from mats of fibrous material. This method however results in undesirable amounts of scrap and is labor intensive, thus resulting in production cost inefficiencies. Still another technique known as a wet slurry process is disclosed, for example, in Keown et al., "Wet Slurry Process Brings Precision To Reinforced Plastics". As disclosed therein, a slurry containing chopped glass strands or fibers is drawn by vacuum into a chamber covered by a screen. As a result, the fibers are deposited on the screen. This approach, however, also has some drawbacks. For example, it is somewhat difficult to consistently obtain the desired fiber orientation and compactness or density of the fibers using this equipment. In addition, the pumps and other equipment required to create the vacuum and draw the slurry through the screen may be unduly complex and difficult to maintain. Furthermore, the process is relatively slow. An improved wet slurry process is disclosed in commonly assigned U.S. Pat. No. 5,039,465, which is also hereby incorporated by reference. The process disclosed therein teaches drawing the slurry through the screen by raising the screen through a tank containing a slurry of fibers resulting in the fibers being deposited on the screen. Further disclosed are unique configurations for the holes in the screen to direct the fibers into desired orientations. Also disclosed is the fact that the size and spacing of the openings in the screen can affect the relative thickness of the deposited fibers from one section to another of the screen since more of the liquid will tend to pass through larger openings as the screen is raised thereby depositing a greater number of fibers in that area.

Of concern in any preform forming process is the control of the deposition of fibers at different locations along the screen. Generally, it is desirable to have a uniform thickness of fibers across the entire preform. However, at times it is desirable to provide areas of increased thickness or decreased thickness depending upon the part geometry and use in its finished state. While the methods and apparatus disclosed in commonly assigned U.S. Pat. No. 5,039,465 are satisfactory and have enjoyed great commercial success, the present invention is believed to even further improve the art.

SUMMARY OF THE INVENTION

In accordance with the teachings of the present invention, an apparatus and method are disclosed for forming fiber preforms in which the quantity of fibers deposited on selected screen portions is regulated. A preform is created using a screen having a predetermined configuration which is supported on a frame. The screen is disposed near the bottom portion of a tank which contains a slurry of liquid and a mass of fibers. The screen is raised from the bottom portion of the tank to a top portion of the tank causing the liquid of the slurry to pass through the openings in the screen, the fibers from the slurry being deposited on the screen. The flow of liquid through selected portions of the screen is regulated by means which selectively control the flow and therefore the fiber deposition on the selected screen portions.

BRIEF DESCRIPTION OF THE DRAWINGS

The various advantages of the present invention will become apparent to one skilled in the art after reading the following specification and by reference to the drawings in which.

DESCRIPTION OF THE PREFERRED EMBODIMENT

It should be understood from the outset that the scope of the present invention need not be limited to the particular examples used in connection with this invention since those skilled in the art will appreciate that its teachings can be used in a wide variety of applications. With this caveat in mind, the present invention will be described for exemplary purposes embodied in a wet slurry process, an example of which is disclosed in the aforementioned, commonly assigned U.S. Pat. No. 5,039,465.

Figure 1:
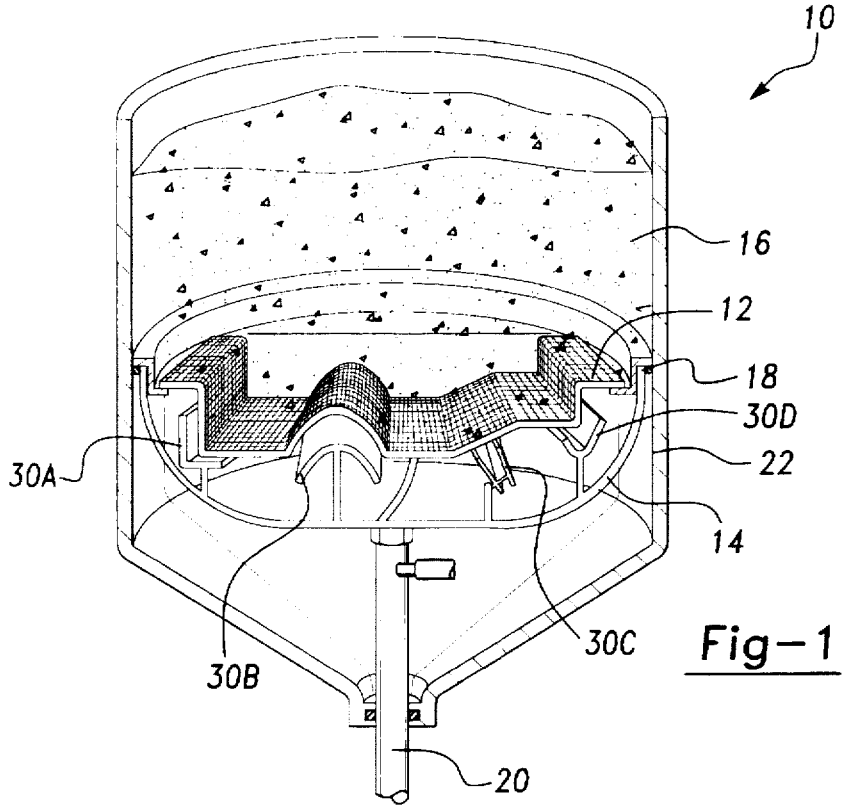
FIG. 1 is a partial perspective view of an apparatus made in accordance with the teachings of the present invention with the screen positioned near the bottom of the tank.

Referring now to the Figures, the present apparatus 10 for making fiber reinforced plastic preforms from a wet slurry is shown in FIGS. 1 through 4. FIG. 1 shows the apparatus 10 in its starting position. In FIG. 1, a contoured screen 12 having a predetermined configuration and containing openings has been placed in a frame and lowered to the bottom of a tank 22. The tank 22 is then filled with water. A mass of chopped reinforcing fibers, such as glass, graphite, polyester, or other suitable reinforcing fibers, is then added to the liquid above the screen to create a slurry 16. A binder is preferably added to the slurry for the purposes of maintaining the shape of the preform after the water is eventually removed during the subsequent drying process that will be discussed later herein. The binder can take various forms and can be a liquid solution added to the slurry or the binder can be pre-applied to the reinforcing fibers. Alternately, the binder may be fibrils (short fibers) of thermoplastic material which are mixed in with the slurry and will become soft and sufficiently tacky to bind the reinforcing fibers together during the subsequent drying step.

Seals 18 are present between the screen 12 and the tank 22. In the preferred embodiment, the screen 12 and frame 14 are raised to the top of the tank 22 by activating a piston 20 which is attached to the frame 14. Provision is made for mixing the reinforcing fibers, the binder, and the water so as to create a generally uniform, evenly distributed dispersion of the constituents. This may be accomplished by way of a bubbler system or by cycling the screen 12 up and down to create a surging action.

Figure 2:
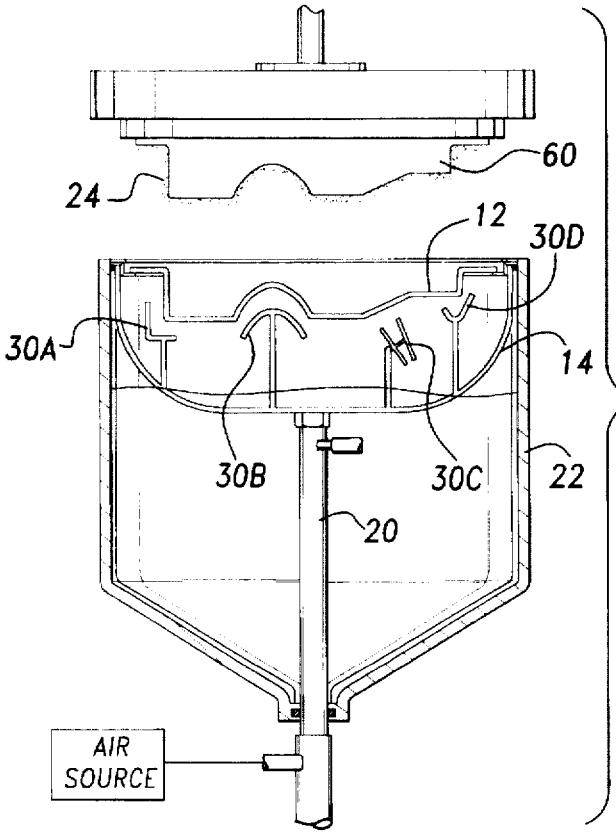
FIG. 2 is a partial front sectional view of the apparatus after the screen has been raised to the top of the tank and the fiber preform removed.

FIG. 2 shows the present apparatus in its finished position. In FIG. 2, the screen 12 has been pushed up through the slurry 16 (shown in FIG. 1) to the top of the tank 22 by piston 20 which is attached to the frame 14. As the screen 12 is pushed to the top of the tank 22, the fibers are deposited on the screen 12 in the predetermined configuration of screen 12 thereby forming a preform 24 having substantially the same configuration as screen 12. The rate of upward travel of the screen 12 can be adjusted as required. The rate should be fast enough to create a vacuum under the sealed screen 12, thereby generating a downward pressure ensuring rapid flow of the fluid through the openings in the screen 12. The rate should not be so fast, however, to collapse or damage screen 12.

Figure 3:
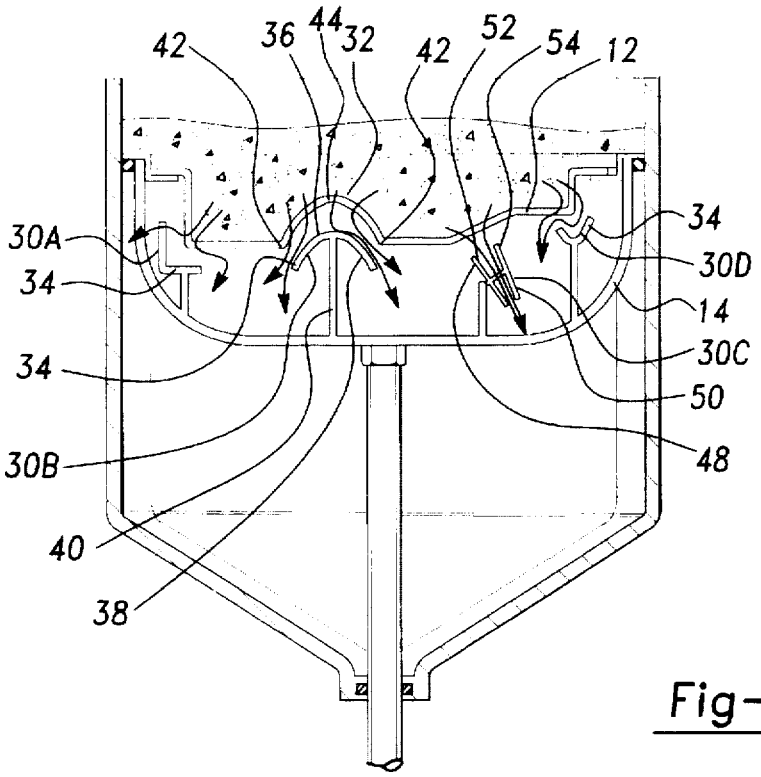
FIG. 3 is a sectional view showing the flow lines of the liquid passing through the screen and control devices of the present invention.

As shown in FIGS. 1 through 3, flow diverters or control devices 30A, 30B, 30C, and 30D (collectively referred to as control devices 30) are positioned relative to screen 12 in order to selectively redirect the flow of the water as it passes through screen 12. As best shown in FIG. 3, the control devices 30 are typically positioned in the area of a surface change along the predetermined configuration of screen 12. As the water flows through screen 12, turbulence or vortexes can be created in the areas of changing geometry. The turbulence affects the quantity of water passing through portions of screen 12, which in turn affects the quantity of fibers deposited on that portion of screen 12. In areas where a relatively large amount of water is passing through screen 12, a relatively thick layer of fibers is deposited. In areas where a relatively small amount of water is passing through the screens, a relatively thinner layer of fibers is deposited. Generally, it is desirable to produce a preform having a uniform material thickness across its entire surface. However, depending upon the finished part geometry and end use, it is at times desirable to selectively create a relatively thicker or thinner layer of fibers in selected areas.

As an example of how the control devices 30 function, the fluid flow about control device 30B will be explained in greater detail. As shown, there is a curved portion 32 of screen 12 with which control device 30B is associated. Control device 30B is comprised of a panel portion 34 having a first side 36 generally directed toward and positioned relative to portion 32 of screen 12. Panel portion 34 also includes a second side 38 from which a support 40 is attached. In the present embodiment, support 40 is attached to frame 14 such that the relative position between screen 12 and control device 30B does not change as screen 12 passes through the slurry. As the water passes through screen 12, there would be a tendency for turbulence to be created at the lower comers 42 of portion 32 which would result in a decrease in the thickness of the fiber layer at those areas. To control this effect, panel portion 34 is configured to be positioned closer to the surface of portion 32 at the corner sections 42 than it is at a more central location 44 of portion 32. As a result of this reduced distance, a smaller cross-section is created through which the water may flow, therefore increasing the velocity of the water flowing through the area. The increased velocity creates a low pressure area below comers 42 which draws a greater quantity of slurry toward comers 42 as it pulls additional water through the screen portion in that area. As discussed above, as a greater amount of water is drawn through an area of the screen, a greater number of fibers are deposited in that screen area, which in the case of comers 42, will result in a uniform overall thickness of the preform. Control devices 30A and 30D represent additional configurations which panel portion 34 can take. As with control device 30B, control devices 30A and 30D affect the quantity of water passing through a related portion of screen 12.

Another form of control device 30 is shown as control device 30C in which a first plate 48 and a second plate 50 are fixedly positioned at an angle relative to one another such that first surfaces 52 and 54 of first plate 48 and second plate 50, respectively, are facing one another. As shown in control device 30C, the upper ends of first and second plates 48 and 50 are spaced a greater distance than the lower ends of plates 48 and 50. As such, as the water flows between plates 48 and 50, the velocity is increased and a lower pressure area is created near the top of device 30C. Again, a lower pressure draws more water through the screen in the adjacent area, thereby increasing the amount of fibers deposited in that area.

Figure 4:
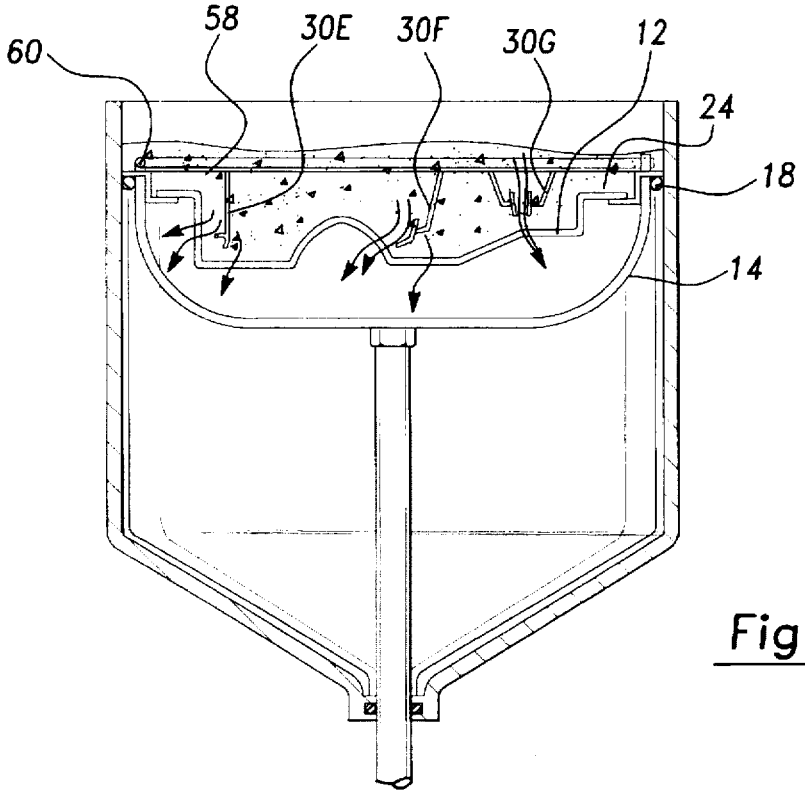
FIG. 4 is a sectional view showing the flow lines of the liquid passing through the screen and an alternate embodiment of the control devices of the present invention.

FIG. 4 shows alternate locations where control devices 30E, 30F, and 30G are located above screen 12. In this embodiment, a support 58 is provided above screen 12 which is connected to frame 14. Support 58 in the present embodiment is pivotably mounted at a first end 60 such that it may be moved to provide greater access to preform 24 during removal from screen 12.

Referring again to FIG. 2, a vacuum pickup 60 can be used to remove the preform 24 from the screen 12. Moisture is removed from the preform in any conventional manner. Preferably, the preform is heated for a sufficient time and temperature to evaporate any water and to melt the thermoplastic fibrils to thereby tie the reinforcement fibers together and substantially maintain the shape of the preform 24 as defined by the predetermined configuration of screen 12. As an alternate to the vacuum pickup 60, the preform 24 may be dried while remaining on screen 12 and then the screen inverted and the preform 24 blown off of the screen.

Figure 5:
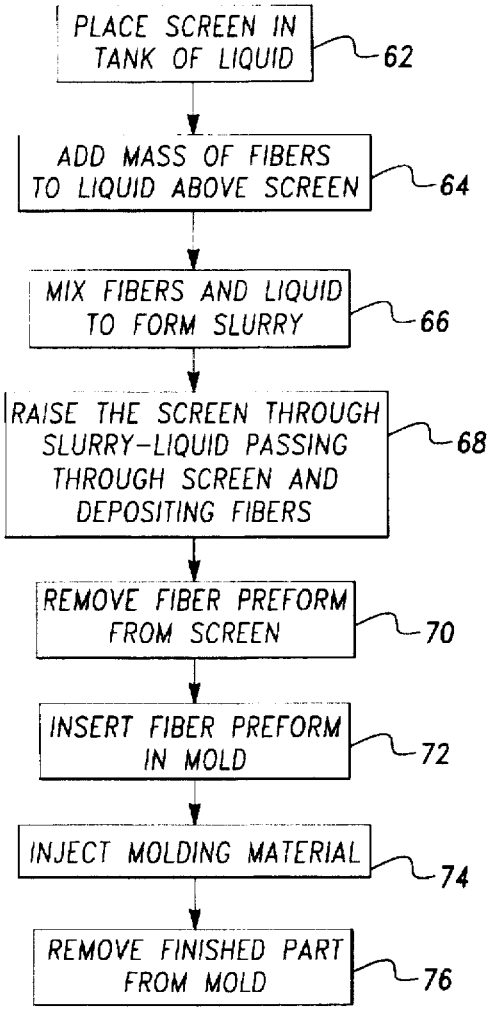
FIG. 5 is a flow chart representing the method as taught by the present invention.

FIG. 5 shows a flow diagram in which the preform is created and utilized to form a finished part. The first step of the process 62 is placing the screen in a tank of liquid (such as water). The next step 64 is the addition of a mass of fibers to the liquid which is above screen 12 which are subsequently mixed 66 such that a slurry is formed of the fibers and liquid. Subsequently at 68, the screen is raised through the slurry wherein the liquid passes through the screen, thereby depositing fibers as selectively redirected by control devices 30 on screen 12. Following step 68, the fiber preform is removed from screen 12 as indicated at 70. After removal and any additional steps necessary to prepare the preform for the mold, the fiber preform is inserted into a mold as indicated at 72. Molding material is then injected into the mold 74 and upon curing the finished part is removed from the mold as indicated at 76.

Figure 6:
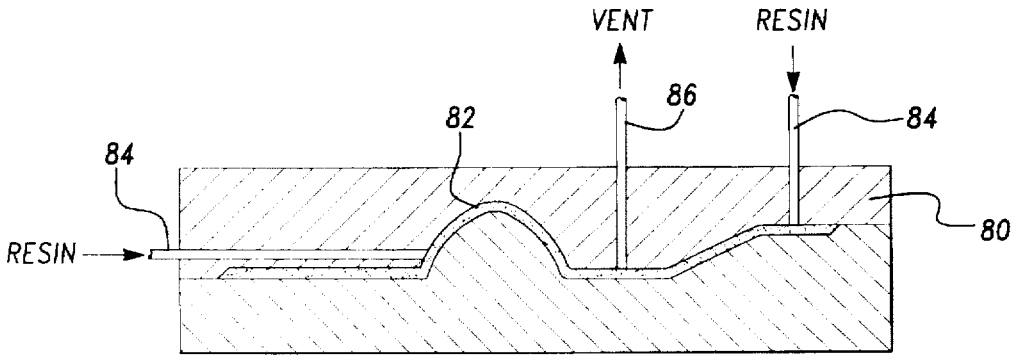
FIG. 6 is a sectional side view of a mold for use in the method of using the present invention.

FIG. 6 is a side view of a mold 80 into which a dried and prepared preform 82 obtained from the aforementioned process has been placed. Once preform 82 has been placed in mold 80, resin is injected through conduits 84 into preform 82. Air vent 86 is also provided to permit the escape of air from preform 82 to prevent the formation of voids or other undesirable characteristics in the finished product. After the preform 82 has been impregnated with the resin and cured, the finished part can then be removed from mold 80. More details about this process can be obtained by studying the aforementioned commonly assigned U.S. Patents which are hereby incorporated by reference.

The foregoing discussion discloses and describes a preferred embodiment of the present invention. One skilled in the art will readily recognize from such discussion and from the accompanying drawings and claims, that various changes, modifications, and variations can be made therein without departure from the true spirit and fair scope of the invention as defined in the following claims.

What is claimed is:

1. An apparatus for forming fiber preforms comprising:

a tank having a top portion and a bottom portion, the tank containing a slurry of a liquid and a mass of fibers;

a screen having a predetermined configuration being disposed within the tank, the screen having a surface containing openings;

frame means for supporting the screen;

means for raising the screen through the slurry with the liquid passing through the openings in the screen and the fibers being deposited on the screen thereby forming a preform having substantially the same configuration as the screen; and at least one flow diverter positioned in spaced relation to the screen for selectively controlling the flow of liquid through portions of the screen to regulate the quantity of fibers deposited on the screen.

2. The apparatus of claim 1 wherein a plurality of flow diverters are located at different positions beneath the screen to provide a substantially uniform thickness of fibers to be deposited on the screen.

3. The apparatus of claim 1 wherein the flow diverter causes a relative increase in the quantity of liquid passing through the screen at a portion of the screen to create a relatively thicker layer of the fibers at the portion.

4. The apparatus of claim 1 wherein the flow diverter causes a relative decrease in the quantity of liquid passing through the screen at a portion of the screen to create a relatively thinner layer of the fibers at the portion.

5. The apparatus of claim 1 wherein the flow diverter is connected to the frame means which supports the screen thereby the relative position of the screen and the control means remain constant as the screen is raised through the slurry.

6. The apparatus of claim 5 wherein the flow diverter is located between the screen and the bottom portion of the tank.

7. The apparatus of claim 5 wherein the flow diverter is located between the screen and the top portion of the tank.

8. The apparatus of claim 1 wherein the flow diverter further comprises:

a panel portion having a first side and a second side, the first side being directed toward and positioned relative to the screen; and support means for supporting the panel portion relative to the screen.

9. The apparatus of claim 8 wherein the first surface of the panel portion is substantially complementary to the screen portion adjacent to the flow diverter.

10. The apparatus of claim 9 wherein the screen portion is substantially planar and the panel portion is substantially planar, the panel portion being positioned at a selected angle to the screen portion thereby regulating the flow of liquid through the screen portion.

11. The apparatus of claim 9 wherein the screen portion is substantially arcuate and the panel portion is substantially arcuate, the panel portion being selectively arced such that the spacing between the first surface and the screen portion varies thereby affecting the velocity of the liquid flowing between the screen portion and the first surface such that the flow of liquid through the screen portion is regulated.

12. The apparatus of claim 1 wherein the flow diverter further comprises:

a first plate having a first end, a second end, and a first surface;

a second plate having a first end, a second end, and a first surface;

the first and second plate being fixedly position relative to one another such that the first surface of the first plate and the first surface of the second plate are facing one another; and wherein the first end of said first and second plates are spaced an amount different than that of said second end of said first and second plates thereby altering the velocity of the liquid flowing between said first and second plates which regulates the flow of liquid through the screen portion adjacent the flow diverter.

13. An apparatus for forming fiber preforms comprising:

a tank having a top portion and a bottom portion, the tank containing a slurry of a liquid and a mass of fibers;

a screen having a predetermined contour disposed within the tank, the screen having a surface containing openings;

a frame for supporting the screen;

a mechanism for raising the screen through the slurry with the liquid passing through the openings in the screen and the fibers being deposited on the screen thereby forming a preform having substantially the same configuration as the screen; and at least one flow diverter spaced from the screen for directing the flow of liquid through portions of the screen to regulate the fiber deposition on the screen.

14. The apparatus of claim 13 wherein said at least one flow diverter further comprises:

a panel shaped to substantially compliment the contour of a portion of the screen.

15. The apparatus of claim 13 wherein said at least one flow diverter is connected to the frame such that the space between the screen and the flow diverter remains constant as the screen is raised through the slurry.

16. The apparatus of claim 14 further comprising:

a diverter support for connecting the panel to the frame such that the space between the screen and the panel remains constant as the screen is raised through the slurry.

17. The apparatus of claim 14 wherein one end of the panel is positioned at a distance from the screen different than an opposite end of the panel.

18. The apparatus of claim 13 wherein said at least one flow diverter is positioned between the screen and the top portion of the tank.

19. The apparatus of claim 13 wherein said at least one flow diverter is positioned between the screen and the bottom portion of the tank.

20. An apparatus for forming fiber reinforced composite components comprising:

a tank having a top portion and a bottom portion, the tank containing a slurry of a liquid and a mass of fibers;

a screen having a predetermined configuration disposed within the tank, the screen having a surface containing openings;

a frame for supporting the screen;

a mechanism for raising the screen through the slurry with the liquid passing through the openings in the screen and the fibers being deposited on the screen thereby forming a preform having substantially the same configuration as the screen;

at least one flow diverter spaced from the screen for directing the flow of liquid through portions of the screen to regulate the fiber deposition on the screen; and a mold for receiving the preform, the mold having at least one conduit providing a path for resin to be injected into the preform.

* * * * *